US009907410B2

(12) United States Patent
Roberts Moosa et al.

(10) Patent No.: US 9,907,410 B2
(45) Date of Patent: Mar. 6, 2018

(54) PORTABLE CHANGING TABLE

(71) Applicant: 4DCM, LLC, Midlothian, VA (US)

(72) Inventors: Brenda Lee Roberts Moosa, Midlothian, VA (US); Mahnaz Moosa, Midlothian, VA (US); Bruce Seymour Ferris, Richmond, VA (US); Catherine P. Barnes, Glen Allen, VA (US); Suzy Smithson, Richmond, VA (US); Eirikur Blumenstein, Reykjavik (IS)

(73) Assignee: 4DCM, LLC, Midlothian, VA (US)

( * ) Notice: Subject to any disclaimer, the term of this patent is extended or adjusted under 35 U.S.C. 154(b) by 0 days.

(21) Appl. No.: 15/356,814

(22) Filed: Nov. 21, 2016

(65) Prior Publication Data

US 2017/0156510 A1 Jun. 8, 2017

Related U.S. Application Data

(60) Provisional application No. 62/262,110, filed on Dec. 2, 2015.

(51) Int. Cl.

| | |
|---|---|
| ***A47D 5/00*** | (2006.01) |
| ***A47D 9/00*** | (2006.01) |
| ***A47D 13/02*** | (2006.01) |

(52) U.S. Cl.

CPC ..... *A47D 5/006* (2013.01); *A47D 5/00* (2013.01); *A47D 5/003* (2013.01); *A47D 9/005* (2013.01); *A47D 13/02* (2013.01)

(58) Field of Classification Search

CPC ..... A47D 5/00; A47D 5/003; A47D 5/006; A47D 9/00; A47D 9/005; A47D 9/02; A47D 13/00; A47D 13/02

See application file for complete search history.

(56) References Cited

U.S. PATENT DOCUMENTS 4,123,809 A * 11/1978 Pugh ..... A47K 3/034 4/551
4,550,456 A * 11/1985 Allen ..... A47D 9/02 5/102
5,299,336 A 4/1994 Marteeny
(Continued)

OTHER PUBLICATIONS

International Search Report and Written Opinion for PCT Appl. No. PCT/US2016/063062, dated Feb. 16, 2017, 7 pages.
(Continued)

*Primary Examiner* — Robert G Santos
*Assistant Examiner* — David R Hare
(74) *Attorney, Agent, or Firm* — Patent Law of Virginia, PLLC; Brian J. Teague

(57) ABSTRACT

A portable changing table comprises a flexible hanging support having upper and lower ends, a chamber adapted to receive and hold a child during diapering, and left and right support straps. The upper end of the hanging support has at least one hook for hanging the changing table during use. The hanging support is adapted to hang substantially vertically during use. The chamber is attached to the lower end of the hanging support such that the chamber hangs from the hanging support during use. The chamber comprises a floor, a rear wall having a bottom edge foldably attached to a rear edge of the floor, a front wall having a bottom edge foldably attached to a front edge of the floor, a flexible left side wall, and a flexible right side wall.

5 Claims, 3 Drawing Sheets

(56) References Cited

U.S. PATENT DOCUMENTS

| | | | | |
|---|---|---|---|---|
| 5,615,433 | A | 4/1997 | Martin | |
| 6,154,906 | A | 12/2000 | Erli | |
| 6,272,704 | B1 * | 8/2001 | Cutler | A47D 15/003 5/420 |
| 6,308,641 | B1 * | 10/2001 | Kingbury | A47B 5/04 108/42 |
| 6,327,726 | B1 * | 12/2001 | Weber | A47D 5/006 297/219.1 |
| 6,378,445 | B1 | 4/2002 | Willard, Sr. et al. | |
| 6,389,624 | B1 | 5/2002 | Madole | |
| 6,421,856 | B1 | 7/2002 | Furnback | |
| 6,581,228 | B1 | 6/2003 | Boskovich et al. | |
| 6,918,147 | B2 * | 7/2005 | Stackman | A47D 15/003 4/551 |
| 7,467,433 | B2 | 12/2008 | Wong | |
| 7,500,278 | B2 | 3/2009 | Leach | |
| 7,587,774 | B2 | 9/2009 | Mayes et al. | |
| 7,618,055 | B2 | 11/2009 | Chuah et al. | |
| 7,681,267 | B1 | 3/2010 | Hall | |
| 7,891,034 | B2 | 2/2011 | Smith | |
| 8,001,637 | B1 * | 8/2011 | Gant | A47D 5/003 5/655 |
| 8,276,228 | B1 | 10/2012 | Gant et al. | |
| 8,480,114 | B1 | 7/2013 | Grantz | |
| 8,677,534 | B2 * | 3/2014 | Gant | A47D 5/00 5/655 |
| 8,695,137 | B1 | 4/2014 | Hanson | |
| 8,732,873 | B2 | 5/2014 | Iskowitz | |
| 9,301,623 | B2 * | 4/2016 | Herdman | A47D 5/00 |
| 2006/0289582 | A1 | 12/2006 | Killilea | |
| 2007/0122066 | A1 * | 5/2007 | Landay | A47G 9/086 383/16 |
| 2009/0126101 | A1 | 5/2009 | Le | |
| 2010/0138995 | A1 * | 6/2010 | Smith | A47D 5/006 5/424 |
| 2011/0023236 | A1 * | 2/2011 | Sanders | A45C 9/00 5/655 |
| 2011/0296619 | A1 | 12/2011 | York et al. | |
| 2013/0312197 | A1 * | 11/2013 | Sanders | A47D 5/00 5/655 |
| 2014/0374305 | A1 * | 12/2014 | Fimbrez | A45C 9/00 206/581 |

OTHER PUBLICATIONS

Baby Hammock website archive, Hushamok, 2014, 1 page, available at http://web.archive.org/web/20141024185647/http://hushamok.com/collections/add-ons/products/baby-hammock.

* cited by examiner

PORTABLE CHANGING TABLE

CROSS-REFERENCE TO RELATED APPLICATIONS

This application claims priority to U.S. Provisional Application Ser. No. 62/262,110, filed Dec. 2, 2015, the contents of which are incorporated herein by reference in its entirety.

FIELD OF THE INVENTION

The present invention relates generally to baby and child care accessories, and more specifically to portable changing tables.

BACKGROUND

As parents of babies and young children know, it can be difficult to change a child's diaper when out in public. Many public restrooms do not have changing tables. When changing tables are present, the changing tables may be dirty, may be contaminated with bacteria and viruses, and may be damaged or otherwise unsafe.

What is needed is a safe, strong, and secure surface for changing a child's diaper, which is portable so parents can easily carry it for ready use when needed, which does not have to be laid on a surface to use, and which is simple to deploy, use, and stow.

BRIEF SUMMARY OF THE DISCLOSURE

In one embodiment of the invention, a portable changing table comprises a flexible hanging support having upper and lower ends, a chamber adapted to receive and hold a child during diapering, and left and right support straps. The upper end of the hanging support has at least one hook for hanging the changing table during use. The hanging support is adapted to hang substantially vertically during use. The chamber is attached to the lower end of the hanging support such that the chamber hangs from the hanging support during use. The chamber comprises a floor, a rear wall having a bottom edge foldably attached to a rear edge of the floor, a front wall having a bottom edge foldably attached to a front edge of the floor, a flexible left side wall, and a flexible right side wall. The flexible left side wall has (i) a bottom edge attached to a left edge of the floor, (ii) a rear side edge attached to a left side edge of the rear wall, and (iii) a front side edge attached to a left side edge of the front wall. The flexible right side wall has (i) a bottom edge attached to a right edge of the floor, (ii) a rear side edge attached to a right side edge of the rear wall, and (iii) a front side edge attached to a right side edge of the front wall. Each support strap has an upper end attached to the hanging support and a lower end attached to the front wall of the chamber.

The floor may comprise left, center, and right sections, with each section comprising a flexible envelope enclosing a rigid or semi-rigid support panel and a cushion. The left section is foldably attached to the center section, and the center section is foldably attached to the right section. The rear wall may comprise left, center, and right sections, with each section comprising a flexible envelope enclosing a rigid or semi-rigid support panel and optionally a cushion. The left section is foldably attached to the center section, and the center section is foldably attached to the right section. The front wall may comprise left, center, and right sections, with each section comprising a flexible envelope enclosing a rigid or semi-rigid support panel and optionally a cushion. The left section is foldably attached to the center section, and the center section is foldably attached to the right section.

The lower end of the left strap may be attached to the left section of the front wall, and the lower end of the right strap may be attached to the right section of the front wall.

The portable changing table may further comprise one or more storage pockets attached to the hanging support.

The chamber may include one or more securing straps attached to the floor adapted to retain a child in the chamber during diapering.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
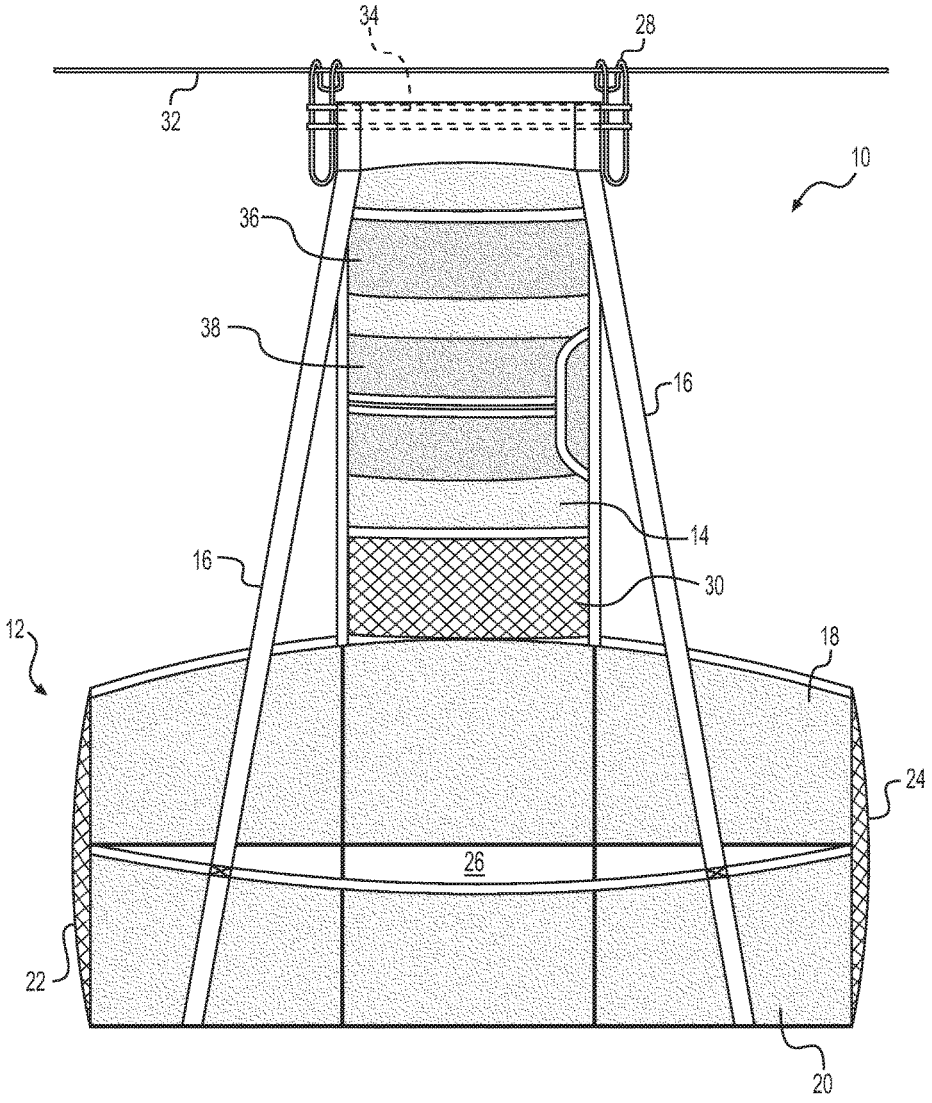
FIG. 1 is a front view of a portable changing table, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a portable changing table. The portable changing table of embodiments of the invention may be used when changing the diaper of a baby or toddler (referred to herein after collectively as a baby). The portable changing table of embodiments of the invention enables a baby to be diapered in many locations in which diapering was not previously feasible, or in which diapering was difficult, awkward, and/or unsanitary, due to the lack of a suitable sturdy horizontal surface on which to diaper the baby. The portable changing table of embodiments of the invention provides an elevated platform upon which a baby may be laid, thereby placing the baby at a convenient height and position for diapering. The portable changing table of embodiments of the invention may be suspended from any suitable suspension point, such as the top edge of a door (e.g., a bathroom stall door or any other type of door). The portable changing table of embodiments of the invention is readily folded into a compact form for storing, such as in a diaper bag, backpack, or stroller. The portable changing table of embodiments of the invention is readily unfolded with one hand. The portable changing table of embodiments of the invention is sturdy, safe, compact, private, and easy to clean.

Referring now to the figures, wherein like numerals indicate like elements throughout, FIG. 1 illustrates a front perspective view of the portable changing table of embodiments of the invention. The portable changing table 10 comprises a basket portion 12 supported at the center rear by a rear hanging panel 14 and at the front by straps 16.

The basket portion 12 comprises a generally horizontal bottom portion 26 (bottom portion 26 is generally horizontal (parallel to the floor and perpendicular to the door or wall on which the device is hung) when the device is deployed and suspended from a suspension point as shown), a rear wall 18 affixed to the back edge of the bottom portion 26, a front wall 20 affixed to the front edge of the bottom portion 26, a left side wall 22 affixed to the left side edge of the bottom portion 26 and to the left side edges of the rear and front walls, and a right side wall 24 affixed to the right side edge of the bottom portion 26 and to the right side edges of the rear and front walls. The rear, front, and side walls 18, 20, 22, 24 project generally upward from the bottom portion 26 when the device is deployed and suspended from a suspension point as shown (the rear wall 18 projects generally vertically upward, while the front wall 20 is typically angled toward the rear of the device corresponding to the angle of the straps 16 to which the front wall 20 is attached). As such, the basket portion 12 forms a secure "container" in which to support and retain the baby (although the baby should not be left unattended in the basket).

Each of the rear wall 18, the front wall 20, the bottom portion 26, and the rear wall 14 comprise strong, durable fabric, such as ripstop nylon, polyester, or any other suitable material. Such material may be waterproof or water-resistant (either inherently or due to a coating applied to the material). Such material may have anti-bacterial properties (typically due to a coating applied to the material). To provide rigidity to the device, the rear wall 18, the front wall 20, and the bottom portion 26 may each comprise three separate rigid panels enclosed in separate pockets formed in the fabric (thus, there are nine panels total in the illustrated embodiment). As seen in the figures, the panels are spaced apart by the stitching that is used to separately form each of the pockets. The spacing of the panels enables the device to be folded for storage, as described below and partly illustrated in FIGS. 3A and B. The pockets may be permanently sealed during construction, such that the panels are not removable by the user. Alternatively, the pockets may be releasably sealed, such as with hook-and-loop fastener or any other suitable mechanism, such that the pockets are selectively openable to remove the panels if desired (such as for cleaning). As another alternative, the pockets may be open on at least one edge, with the panels retained in the pockets via friction.

The panels may be constructed of any suitable durable material, such as carbon fiber sheets or a variety of plastic materials, including acetal, polyvinyl chloride, or polypropylene. The thickness of each panel is determined by the specific material used and the rigidity desired. The panels should be rigid enough so that the device supports a baby up to the specified weight limit (with a suitable safety factor) without sagging too much or collapsing. However, some flexibility in the panels may be desirable; having the panels in the bottom portion be somewhat flexible may increase the comfort of a baby lying on the bottom portion. The panels in the bottom portion are typically thicker and therefore, more rigid than the front and rear wall panels. There may optionally be padding between the top surfaces of the panels in the bottom portion and the top layer of fabric of the bottom portion (or otherwise sewn into or affixed to the top layer of fabric of the bottom portion) for added comfort. In one specific embodiment of the invention, the panels are constructed of a propene polymer. In such an embodiment, the panels in the bottom portion, rear wall, and front wall are all 5 mm thick (although the panels may be any suitable thickness, and the thickness of the panels is different locations may vary).

The panels may be any suitable size to provide the desired overall size of the device. In one specific embodiment of the invention, the panels in the left and right sections of the bottom portion 26 are each about 10 inches×10 inches, and the panel in the center section of the bottom portion is about 10 inches×12 inches. Each panel in the bottom portion would typically have about the same depth, but they could have different widths. For example, the left and right side bottom portion panels may be slightly less wide than the center panel, which may help facilitate folding. The panels in the rear wall 18 and the front wall 20 will typically be differently sized from the panels of the bottom portion, but the panels in the rear wall 18 and the front wall 20 will each be about the same width as the corresponding panels in the bottom portion 26 to facilitate folding. In one specific embodiment of the invention, the bottom portion 26 is 33 inches wide and 10.25 inches deep. It may be desirable to increase the size of the bottom portion to accommodate larger children, which would require larger panels. In order to accommodate larger children, it may also be necessary to use stronger and/or thicker materials, such as for the panels, the front and back walls, the straps, the rear hanging portion, and/or the hooks.

As seen in FIG. 1, the rear wall 18 has a convex shape that is curved upward such that the rear wall is higher in the center. The curvature of the rear wall is provided by the curved top edge of the rear wall and the corresponding curved top edges of the three rear wall panels. The front wall 20 has a concave shape that is curved downward such that the front wall is lower in the center. The curvature of the front wall is provided by the curved top edge of the front wall and the corresponding curved top edges of the three front wall panels. The lower center of the front wall makes it easier to access and diaper the baby. The complementary curves of the rear and front walls (convex and concave, respectively) enable the rear and front walls to fold inward and downward onto the top surface of the bottom portion without the rear and front walls overlapping, as overlapping of the folded rear and front walls would result in undesirable bulkiness when the device is folded. The height of the rear and front walls also needs to be selected appropriately to avoid any overlapping when folded.

The left side wall 22 and the right side wall 24 may be constructed of any suitable material. The side wall material should be flexible to facilitate folding of the device. In the illustrated embodiment of the invention, the left side wall 22 and the right side wall 24 are constructed of a mesh material. A stronger edging material (e.g., nylon webbing) may be used along the top edges of the side walls, connecting the top corners of the front and rear walls, for additional strength.

The rear hanging panel 14 may be a single, relatively wide (e.g., as wide as the middle panels, as shown) piece of strong and durable fabric, such as ripstop nylon, polyester, or any other suitable material. The edges of the rear hanging panel 14 may be reinforced, such as by folding over and stitching the edges, or may be constructed of a different, stronger material (such as nylon webbing). The bottom edge of the rear hanging panel may be affixed (e.g., sewn) to the top edge of the rear wall 18. Alternatively, the bottom edge of the rear hanging panel (including the reinforced edges) may extend further down the rear wall to the bottom edge of the rear wall (where the rear wall and the bottom portion meet). In such an alternative embodiment, the rear hanging panel (including the reinforced edges) would likely be affixed (e.g., sewn) to the rear wall in multiple locations, such as adjacent the top and bottom edges of the rear wall and where the side edges of the rear hanging panel run along the rear wall. In another alternative embodiment, the bottom edge of the rear hanging panel (including the reinforced edges) may extend down the rear wall and across the underside of the bottom portion 26 to the front edge of the bottom portion (where the front wall and the bottom portion meet). In such an alternative embodiment, the rear hanging panel (including the reinforced edges) would likely be affixed (e.g., sewn) to the rear wall and the bottom portion in multiple locations, such as adjacent the top and bottom edges of the rear wall, adjacent the front edge of the bottom portion, and where the side edges of the rear hanging panel run along the rear wall and the underside of the bottom portion. In yet another alternative embodiment, the bottom edge of the rear hanging panel (including the reinforced edges) may extend down the rear wall, across the underside of the bottom portion 26, and up the outer surface of the front wall 20 to the top edge of the front wall. In such an alternative embodiment, the rear hanging panel (including the reinforced edges) would likely be affixed (e.g., sewn) to the rear wall, the bottom portion, and the front wall in multiple locations, such as adjacent the top and bottom edges of the rear wall and the front wall and where the side edges of the rear hanging panel run along the rear wall, the underside of the bottom portion, and the front wall. In an alternative embodiment of the invention, the rear hanging panel may be replaced by two or more separate vertical straps. The length of the rear hanging panel 14, along with the height of the rear wall 18, are selected such that the bottom portion 26 is at a desired height when the device is deployed and hanging on a standard or common height house door or bathroom stall door. In one specific embodiment of the invention, the distance from the top of the device to the bottom of device (when deployed) is about 34 inches.

One or more hooks are affixed at or near the top edge of the rear hanging panel 14. The one or more hooks are used to hang the device over the top edge of, for example, a door 32. The one or more hooks may be curved or may have three linear members joined at right angles. The one or more hooks may be sized to fit over one or more specific types of doors, or may be sized more generally to fit over several different types of doors or other suspension points. The one or more hooks may be adjustable to fit over suspension points having different thicknesses. In the illustrated embodiment, two hooks 28 are used, one near each edge of the rear hanging panel. The two hooks 28 are affixed to opposing ends of a rigid rod 34. The rigid rod 34 maintains the spacing between the hooks 28 and adds stability. Alternatively, a single, relatively wide hook in the center of the top edge of the rear hanging panel may be used. Such a single hook may be as wide or nearly as wide as the rear hanging panel, or may be substantially narrower. The one or more hooks may be constructed of any suitable strong and durable material, such as metal or plastic. The one or more hooks may be affixed to the rear hanging panel using any suitable mechanism or method. In the illustrated embodiment, the rigid rod 34 is secured within a channel in the top of the rear hanging panel 14. Any other suitable hanging mechanism may be used, instead of or in addition to the one or more hooks. As an example, a grommet may be placed near the center of the top edge of the rear hanging panel, such that the grommet may be used to hang the device on a wall- or door-mounted hook (although such an embodiment may not be desirable as such a hook mounting method may not be sufficiently secure).

The basket portion 12 is supported at the front wall by straps 16 to hold the basket portion in the horizontal position when the device is deployed. Straps 16 are constructed out of any suitable strong and flexible material such as nylon webbing. The upper ends of the straps 16 are affixed to the rear hanging panel 14 at or near the top edge, and optionally along the top edge such that the upper ends of the straps meet. The straps 16 may comprise separate left and right straps. Alternatively, the straps 16 may be a single unitary strap, and the upper ends are continuous and affixed along the top edge of the rear hanging panel. The lower ends of the straps 16 may be affixed to the top left front and top right front corners of the basket portion, or may be affixed to the front wall more medially (as illustrated) (yet still far enough apart to enable easy access to the baby in the basket portion). For added strength, the lower ends of the straps 16 may extend past the top edge of the front wall and down the front wall, as illustrated, and possibly along the edge where the front wall 20 meets the bottom portion 26 (such that the lower ends of the straps meet at the front of the device). Alternatively, the lower ends of the straps 16 may extend past the top edge of the front wall and down the front wall, as illustrated, then back across the bottom portion 26, and optionally up the rear wall 18.

One or more storage pockets may be affixed to the rear hanging panel 14 for storing diaper changing accessories. FIG. 1 illustrates a mesh pocket 30, a pocket 38 for storing and dispensing wipes, and a solid pocket 36. The wipes dispensing pocket 38 has an elongated central opening for dispensing and a flap closure for replacing the wipes package (such an elongated central opening may have a selective cover to help prevent the wipes from drying out). Any other suitable number, type, and location of storage pockets may be used. Such storage pockets may have any suitable structure, including having an open top or a selectively sealable closure (using, e.g., hook and loop fastener).

Figure 2:
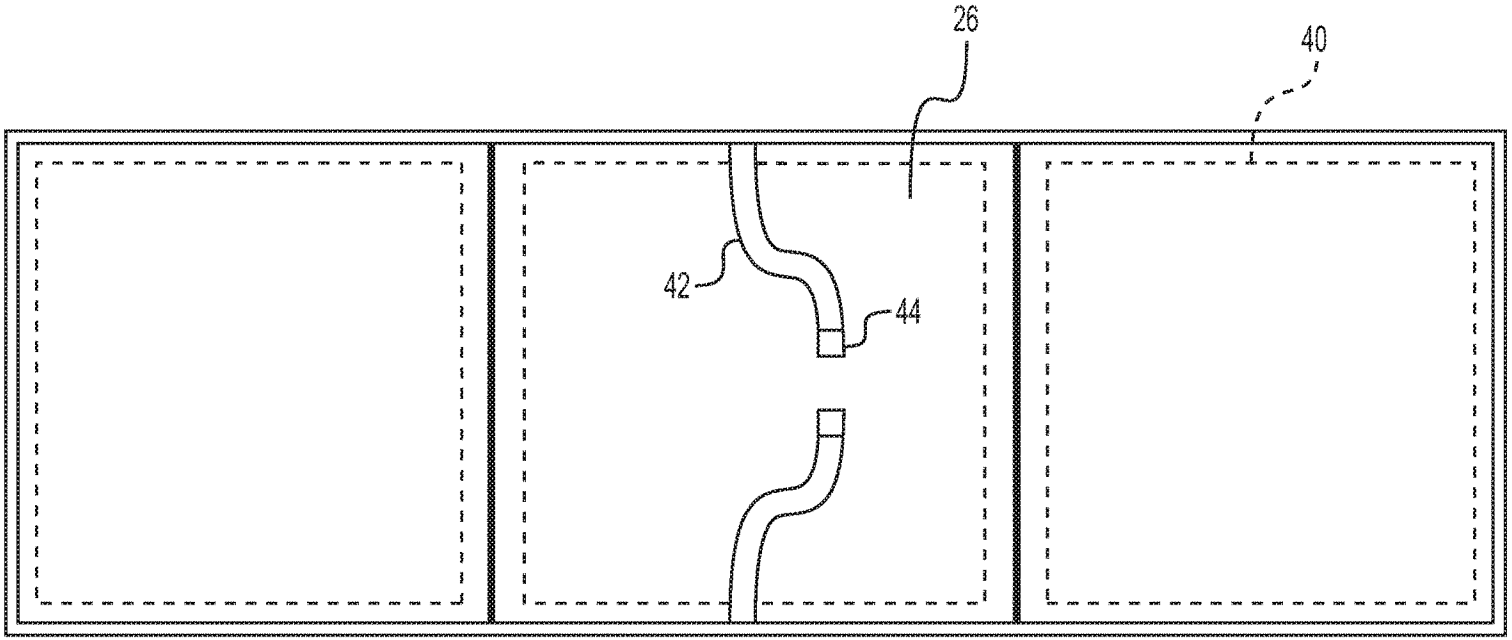
FIG. 2 is a top view of the bottom portion of the portable changing table of FIG. 1.

Referring now to FIG. 2, a top view of the bottom portion 26 of the device is illustrated. As seen in FIG. 2, a safety belt 42 (having a buckle 44 or any other suitable connecting mechanism) may be affixed to the device to secure the baby into the basket portion. Also illustrated in FIG. 2 are the rigid panels 40 in the bottom portion 26.

Figure 3A:
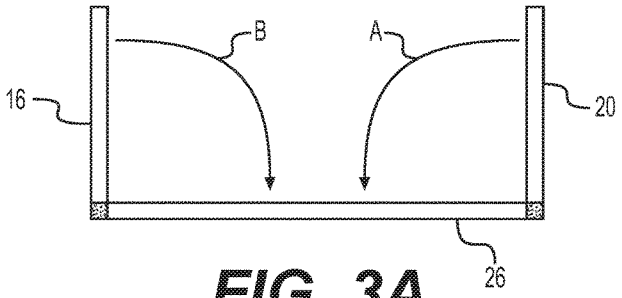
FIGS. 3A and 3B illustrate steps in folding the portable changing table of FIG. 1.

The portable changing table of embodiments of the invention may be readily folded for storage using one hand or two while the device is still hanging from its suspension point. To fold the portable changing table of embodiments of the invention, the user grasps the edge where the center panel of the front wall and the center panel of the bottom portion meet, such as with his/her thumb on the center panel of the front wall and his/her fingers on the center panel of the bottom portion. The grasping pressure will cause the front wall to fold down onto the bottom portion. The user then pushes backward and upward, such that a portion of the bottom portion moves up behind the lower end of the rear hanging panel and such that the back wall folds down onto the bottom portion. FIG. 3A is a partial side view of the device and illustrates the front wall 20 folding down toward the bottom portion 26 (illustrated by arrow A) and the rear wall 16 folding down toward the bottom portion 26 (illustrated by arrow B).

Figure 3B:
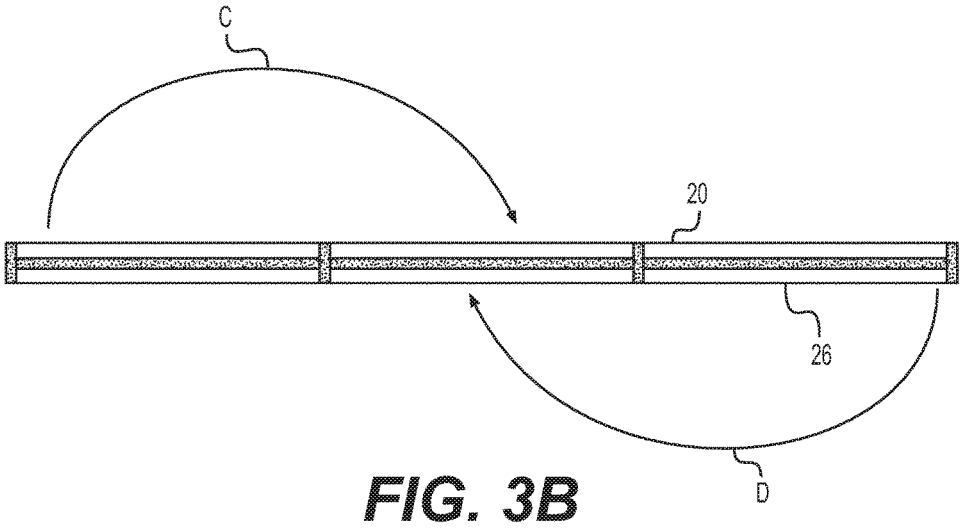

The left panels of the bottom portion, the front wall, and the rear wall are then folded over onto the center panels of the bottom portion, the front wall, and the rear wall. The right panels of the bottom portion, the front wall, and the rear wall are then folded under the center panels of the bottom portion, the front wall, and the rear wall (i.e., a Z-fold). FIG. 3B is a partial front view of the device and illustrates the left panels of the bottom portion 26 and of the front wall 20 (the left panel of the rear wall is not visible in this view) folding over toward the center panels of the bottom portion 26 and of the front wall 20 (the left panel of the rear wall is not visible in this view) (illustrated by arrow C). FIG. 3B also illustrates the right panels of the bottom portion 26 and of the front wall 20 (the right panel of the rear wall is not visible in this view) folding under toward the center panels of the bottom portion 26 and of the front wall 20 (the left panel of the rear wall is not visible in this view) (illustrated by arrow D). Alternatively, the right panel can be folded first and the left panel folded second, or they can both be folded at the same time. Further alternatively, the left panels can be folded under the center panels and the right panels folded over the center panels.

The entire basket portion is now folded, and the folded basket portion is then folded once upward against the center hanging portion. A first fastener (such as hook-and-loop, snaps, straps, or the like) (not illustrated) may be used to secure the folded basket portion to the center hanging portion. The folded basket portion is then folded once again upward against the center hanging portion, and a second fastener (such as hook-and-loop, snaps, straps, or the like) (not illustrated) may be used to secure the folded basket portion to a different location on the center hanging portion. The first and second fasteners are on opposite sides of the folded basket portion. The first fastener would be on the bottom surface of the left panel of the bottom portion and/or on the bottom surface of the right panel of the bottom portion (and on a corresponding location on the hanging center panel) (the first fastener would need to be on the bottom surface of both the left and right panels of the bottom portion to enable either the left panel or the right panel to be folded first). The second fastener would be on the bottom surface of the center panel of the bottom portion (and on a corresponding location on the hanging center panel). The device may then be removed from its suspension point and stored for future use. In alternative embodiments, the above-described fasteners may be omitted, or a different arrangement of fasteners may be used. The above-described folding steps may be performed in a different order than described herein, or different folding steps may be used.

In alternative embodiments of the invention, some or all of the walls may be omitted (i.e., the front wall may be omitted, the side walls may be omitted, and/or the rear wall may be omitted). If the front wall is omitted, the straps would be attached directly to the bottom portion. If the rear wall is omitted, the rear hanging panel would be attached directly to the bottom portion.

The age and/or weight range of a child that may be placed in a portable changing table of embodiments of the invention will typically vary depending on the size of the portable changing table and the materials used and manufacturing methods used to construct the device. The portable changing table of embodiments of the invention will typically have a weight limit specified. Differently sized portable changing tables, which may be constructed of different materials with different strengths, may be provided to be used with different size/weight ranges of children. For example, there may be an infant version and a larger toddler version which is constructed with stronger materials.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A portable changing table, comprising a flexible hanging support having upper and lower ends, the upper end having at least one hook for hanging the changing table during use, the hanging support adapted to hang substantially vertically during use;

a chamber adapted to receive and hold a child during diapering, the chamber attached to the lower end of the hanging support such that the chamber hangs from the hanging support during use, the chamber comprising:

a floor comprising left, center, and right sections, each floor section comprising a flexible envelope enclosing a rigid or semi-rigid support panel and a cushion, the left floor section foldably attached to the center floor section, and the center floor section foldably attached to the right floor section;

a rear wall having a bottom edge foldably attached to a rear edge of the floor, the rear wall comprising left, center, and right sections, each rear wall section comprising a flexible envelope enclosing a rigid or semi-rigid support panel, the left rear wall section foldably attached to the center rear wall section, and the center rear wall section foldably attached to the right rear wall section;

a front wall having a bottom edge foldably attached to a front edge of the floor, the front wall comprising left, center, and right sections, each front wall section comprising a flexible envelope enclosing a rigid or semi-rigid support panel, the left front wall section foldably attached to the center front wall section, and the center front wall section foldably attached to the right front wall section;

a flexible left side wall having (i) a bottom edge attached to a left edge of the floor, (ii) a rear side edge attached to a left side edge of the rear wall, and (iii) a front side edge attached to a left side edge of the front wall; and a flexible right side wall having (i) a bottom edge attached to a right edge of the floor, (ii) a rear side edge attached to a right side edge of the rear wall, and (iii) a front side edge attached to a right side edge of the front wall; and left and right support straps, each support strap having an upper end attached to the hanging support and a lower end attached to the front wall of the chamber.

2. The portable changing table of claim 1, wherein the lower end of the left strap is attached to the left section of the front wall; and wherein the lower end of the right strap is attached to the right section of the front wall.

3. The portable changing table of claim 1, further comprising one or more storage pockets attached to the hanging support.

4. The portable changing table of claim 1, wherein the chamber includes one or more securing straps attached to the floor adapted to retain a child in the chamber during diapering.

5. The portable changing table of claim 1, wherein the lower end of each of the left and right support straps are further attached to the floor.

* * * * *